US007699617B2

(12) United States Patent
Benham et al.

(10) Patent No.: US 7,699,617 B2
(45) Date of Patent: Apr. 20, 2010

(54) MODULAR INTERCONNECT APPARATUS

(75) Inventors: John E. Benham, Torrington, CT (US); David J. Camelio, Foxboro, MA (US)

(73) Assignee: Winchester Electronics Corporation, Wallingford, CT (US)

( * ) Notice: Subject to any disclaimer, the term of this patent is extended or adjusted under 35 U.S.C. 154(b) by 0 days.

(21) Appl. No.: 12/247,426

(22) Filed: Oct. 8, 2008

(65) Prior Publication Data

US 2009/0093138 A1 Apr. 9, 2009

Related U.S. Application Data

(60) Provisional application No. 60/978,201, filed on Oct. 8, 2007.

(51) Int. Cl.
*H01R 12/00* (2006.01)

(52) U.S. Cl. ..... 439/63

(58) Field of Classification Search ..... 439/63, 439/65, 591, 79

See application file for complete search history.

(56) References Cited

U.S. PATENT DOCUMENTS 4,548,453 A * 10/1985 Mummey et al. ..... 439/55
5,169,343 A * 12/1992 Andrews ..... 439/607.11
5,842,872 A * 12/1998 Hosler et al. ..... 439/63
6,344,736 B1 * 2/2002 Kerrigan et al. ..... 324/158.1
6,407,722 B1 * 6/2002 Bogner et al. ..... 343/906
6,814,625 B2 * 11/2004 Richmond et al. ..... 439/681
6,905,367 B2 * 6/2005 Crane et al. ..... 439/608
6,948,977 B1 * 9/2005 Behrent ..... 439/581
6,953,368 B2 * 10/2005 Khemakhem et al. ..... 439/668
7,273,401 B2 * 9/2007 Zaderej et al. ..... 439/886
7,306,468 B2 * 12/2007 Baker ..... 439/76.1
2004/0014360 A1 * 1/2004 Crane et al. ..... 439/608
2004/0094328 A1 * 5/2004 Fjelstad et al. ..... 174/251
2004/0171286 A1 * 9/2004 Baker ..... 439/76.1
2005/0026506 A1 * 2/2005 Kha et al. ..... 439/638
2005/0095900 A1 * 5/2005 Khemakhem et al. ..... 439/408
2005/0191881 A1 * 9/2005 Norris et al. ..... 439/95
2006/0030218 A1 * 2/2006 Khemakhem et al. ..... 439/668
2006/0084286 A1 * 4/2006 Kooiman ..... 439/63
2006/0105636 A1 * 5/2006 Crane et al. ..... 439/701

* cited by examiner

*Primary Examiner*—T C Patel
*Assistant Examiner*—Vladimir Imas
(74) *Attorney, Agent, or Firm*—Rothwell, Figg, Ernst & Manbeck, P.C.

(57) ABSTRACT

The present application provides a modular interconnect apparatus. In one embodiment, the interconnect apparatus includes a frame; and a plurality of coaxial modules connected to the frame, wherein each of the plurality of coaxial modules comprises: a signal contact having a middle portion, a first end and a second end; a first ring shaped ground contact surrounding the first end of the signal contact, wherein the first end of the signal contact is coaxial with the first ring shaped ground contact; a second ring shaped ground contact surrounding the second end of the signal contact, wherein the second end of the signal contact is coaxial with the second ring shaped ground contact; and a housing that houses at least a portion of signal contact and ground contacts.

10 Claims, 11 Drawing Sheets

MODULAR INTERCONNECT APPARATUS

CROSS-REFERENCE TO RELATED APPLICATIONS

The present application claims the benefit of U.S. provisional patent application No. 60/978,201, filed on Oct. 8, 2007, the entire contents of which are incorporated by reference herein.

BACKGROUND

The present invention relates to electrical interconnects.

SUMMARY

An improved modular interconnect for enabling transmission between two components (e.g., two printed circuit boards (PCBs)) is disclosed herein. In some embodiments, the modular interconnect includes: a frame; and a plurality of coaxial modules connected to the frame, wherein each of the plurality of coaxial modules comprises: a signal contact having a middle portion, a first end and a second end; a first ring shaped ground contact surrounding the first end of the signal contact, wherein the first end of the signal contact is coaxial with the first ring shaped ground contact; a second ring shaped ground contact surrounding the second end of the signal contact, wherein the second end of the signal contact is coaxial with the second ring shaped ground contact; and a housing that houses at least a portion of signal contact and ground contacts.

The above and other aspects and embodiments are described below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

DETAILED DESCRIPTION

Figure 1:
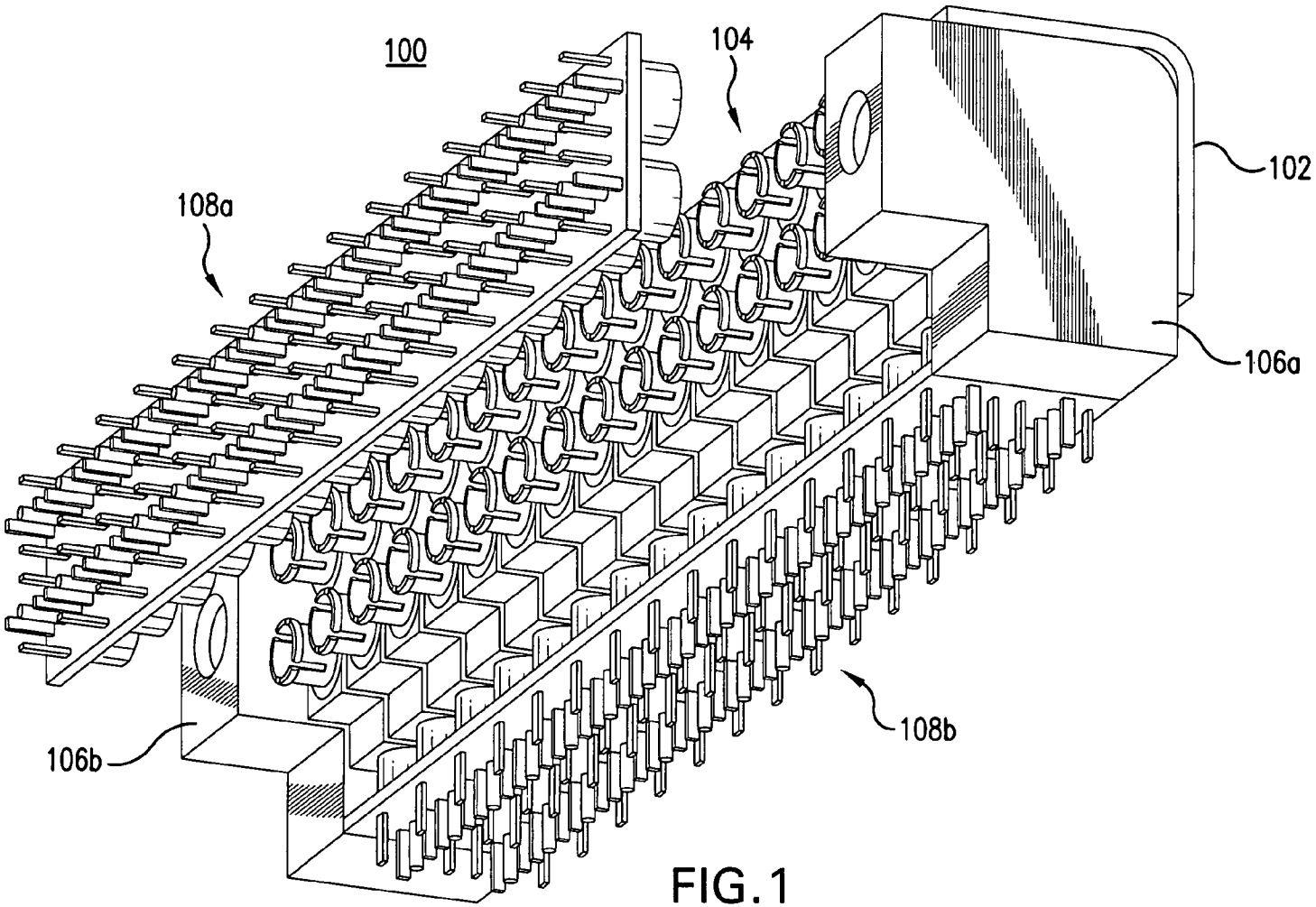
FIG. 1. illustrates an interconnect according to an embodiment of the invention.

The present invention provides an improved interconnect for enabling transmission between two components (e.g., two printed circuit boards (PCBs)). Referring now to FIG. 1, FIG. 1 illustrates an interconnect 100 according to one embodiment of the invention.

Interconnect 100 includes a frame 102, a plurality of coaxial modules 104 connected to frame 102, two guide modules 106*a* and 106*b* connected to frame 102, and two header assemblies 108*a* and 108*b*. Header assembly 108*a* is configured to mate with one side of coaxial modules 104 and a first circuit board (not shown), and, similarly, header assembly 108*b* is configured to mate with another side of coaxial modules 104 and a second circuit board (not shown). In this manner, electrical paths are created between the first circuit board and the second circuit board.

Figure 2:
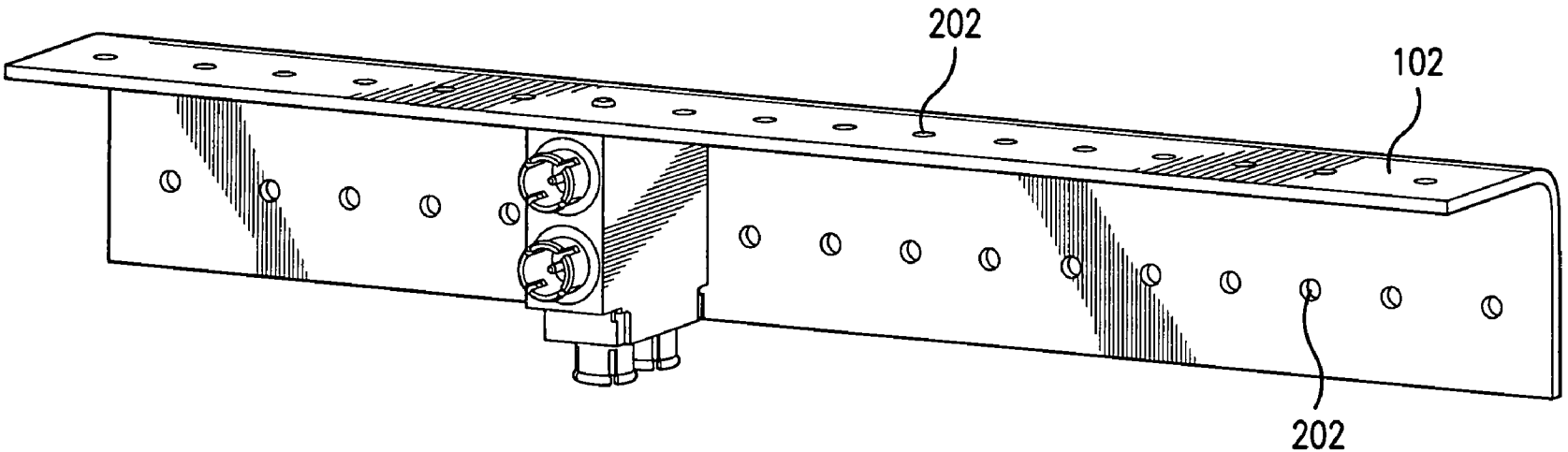
FIG. 2. illustrates a frame and a coaxial module of the interconnect.

Referring now to FIG. 2, FIG. 2 shows a single coaxial module 104 connected to frame 102. In the embodiment shown, frame 102 is an L-shaped frame, however other shapes are contemplated. Frame 102 includes a plurality of holes 202. Each hole 202 is configured to receive and hold a member 402 that projects from a housing 404 (see FIG. 4) of a coaxial module 104. In this way, a plurality of coaxial modules can be connected or "snapped" to frame 102.

Figure 3:
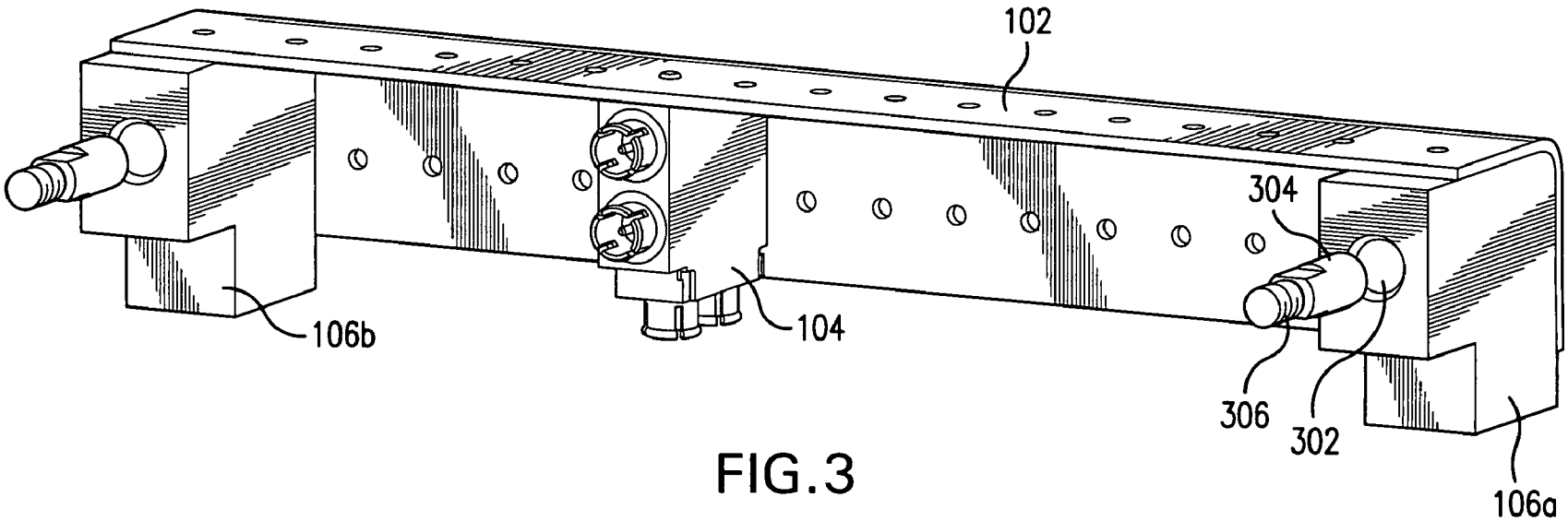
FIG. 3 illustrates two guide modules, a frame and a coaxial module of the interconnect.

Referring now to FIG. 3, FIG. 3 shows guide modules 106*a* and 106*b* connected to frame 102. Like coaxial modules 104, guide modules 106 are configured to connect to frame 102 using holes 202. That is, each guide module 106 may include one or more members projecting from the body of the guide module and each of these members are configured to fit tightly in a corresponding hole 202 of frame 102. As further shown, each guide module 106 includes a cavity 302 for receiving a guide pin 304. Guide pin 304 may be threaded at one end 306. The threaded end 306 is configured to fit into a corresponding screw hole in a circuit board to which interconnect 100 mates, thereby securing interconnect 100 to the circuit board.

Figure 4:
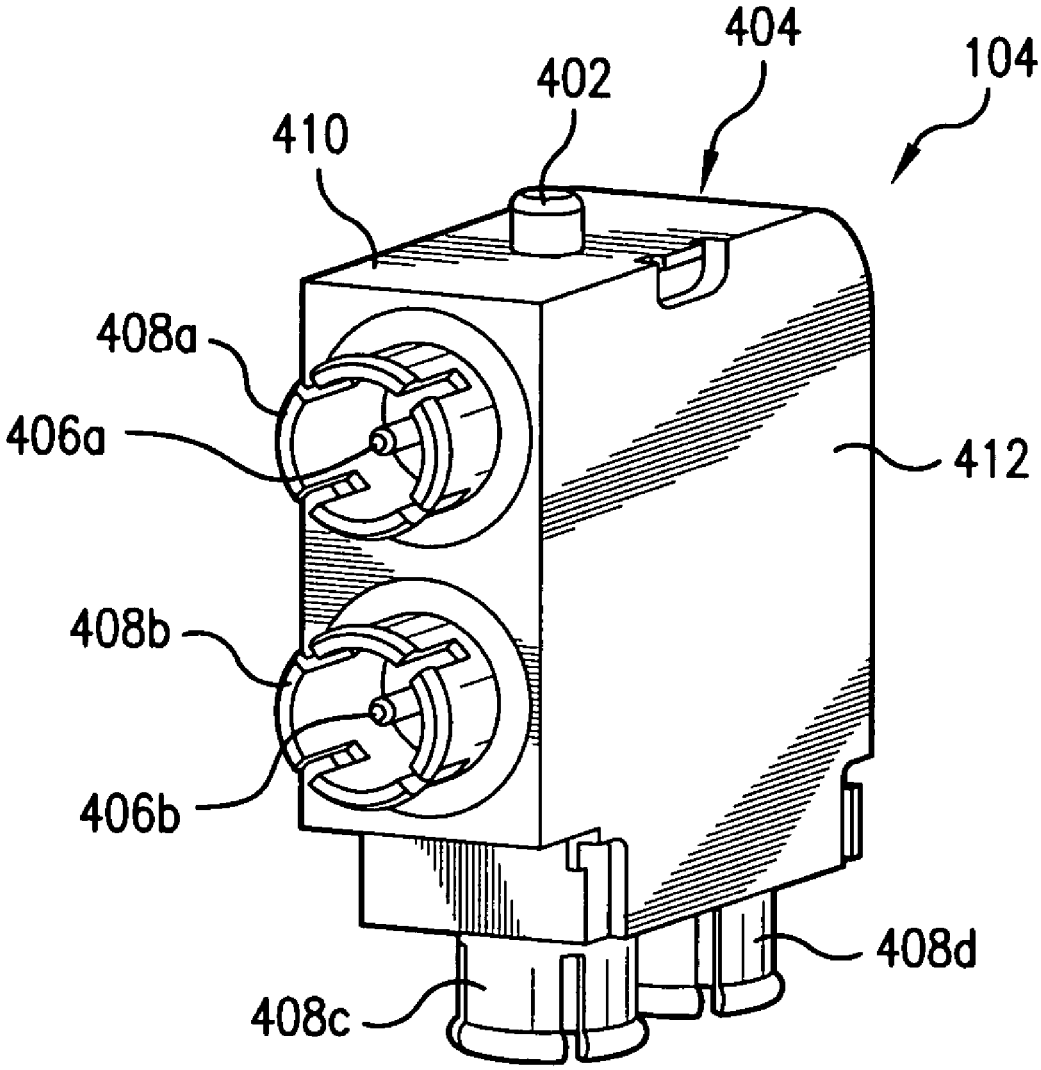
FIG. 4 illustrates a coaxial module according to an embodiment of the invention.

Referring now to FIG. 4, FIG. 4 shows a coaxial module 104 according to an embodiment of the invention. In the embodiment shown, coaxial module 104 includes a housing 404 and a member 402 projecting from housing 404. Housing 404 is configured to partially contain two signal contacts (contact 406*a* and contact 406*b*) and four ground contacts (contacts 408*a-d*). As shown, each ground contact 408 surrounds an end of a signal contact 406, and each ground contact 408 is coaxial with the end of the signal contact 406 that it surrounds.

Figure 5:
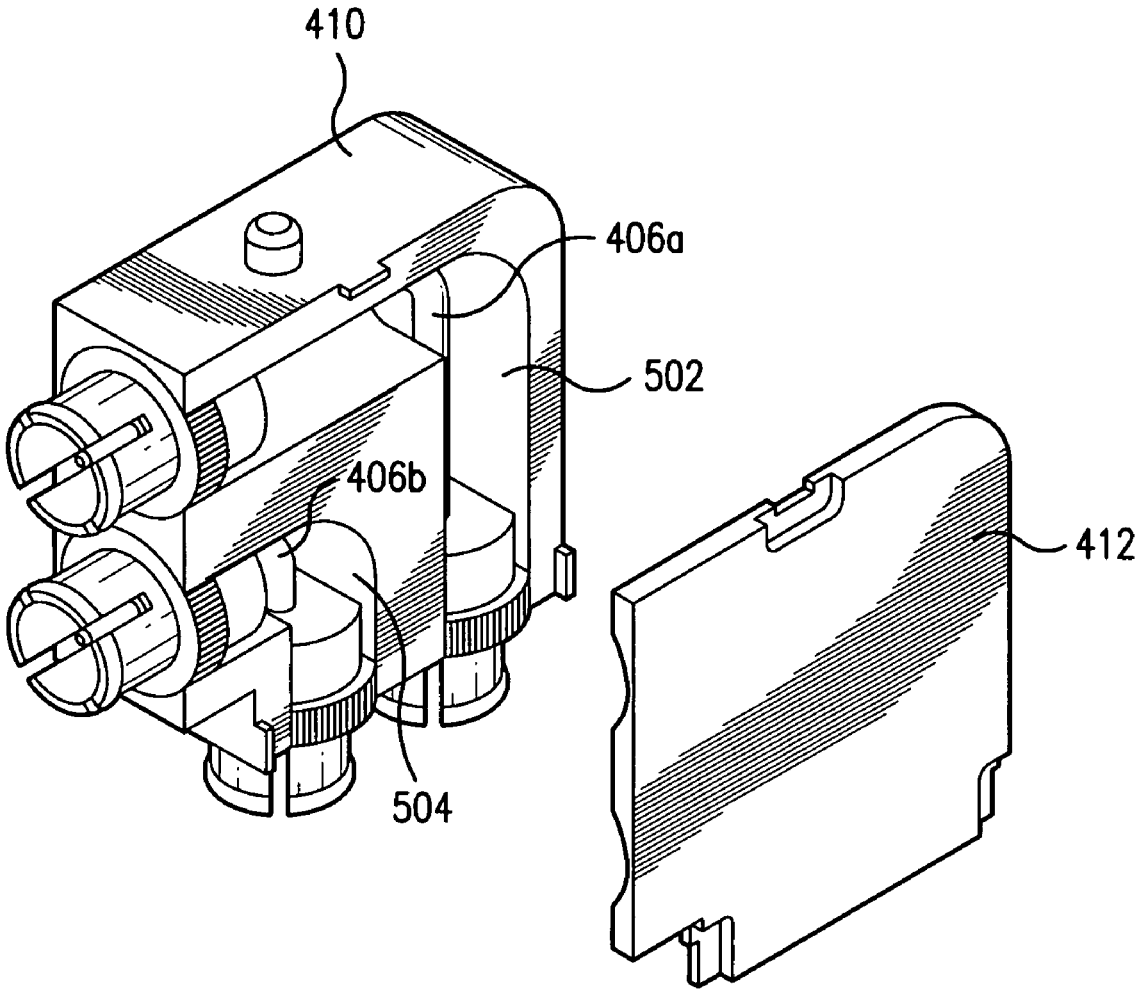
FIGS. 5-8 further illustrate the coaxial module.
Figure 6:
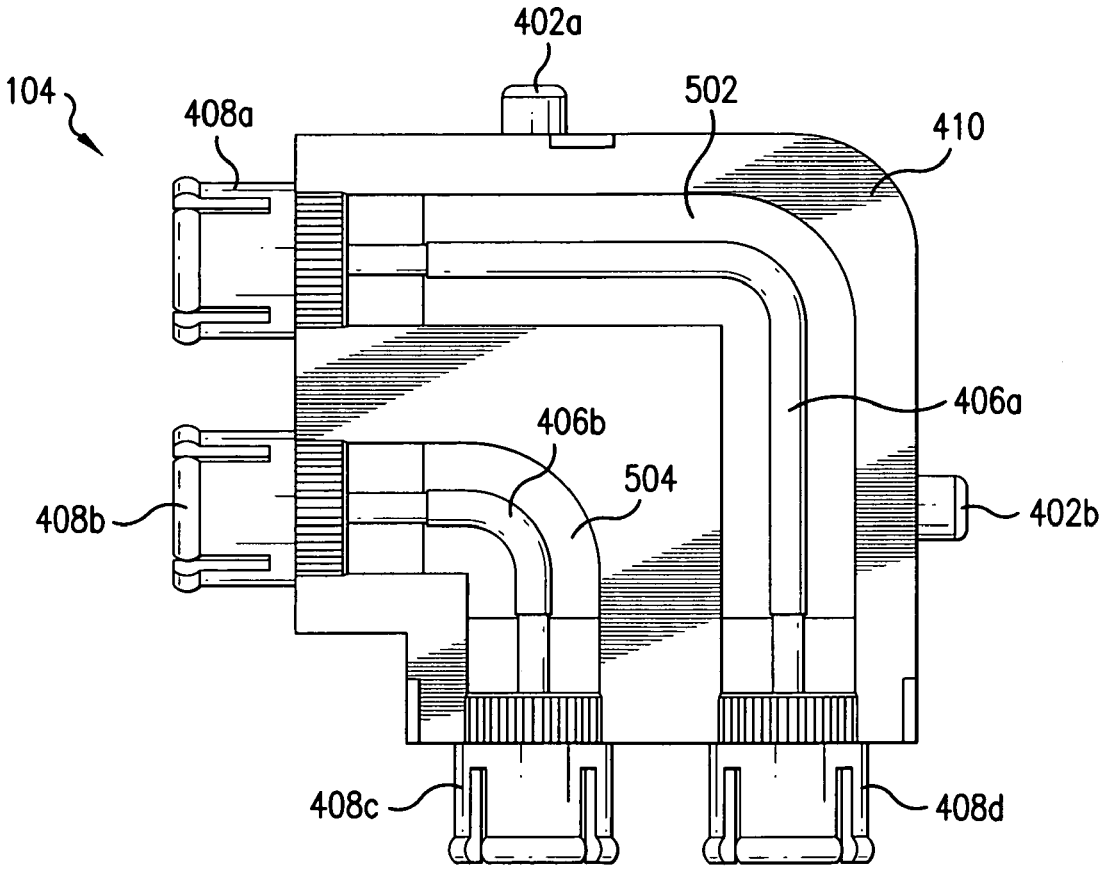
Figure 7:
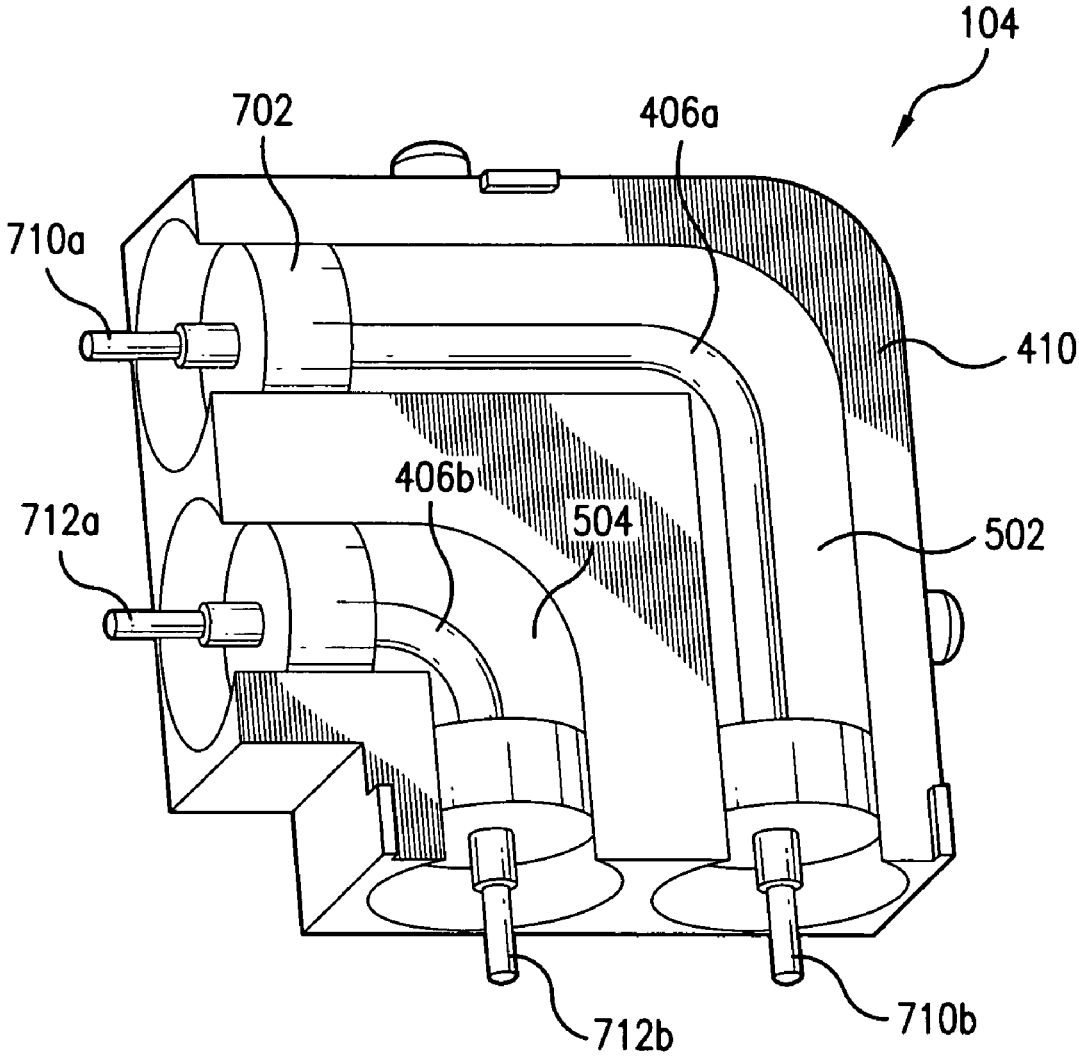
Figure 8:
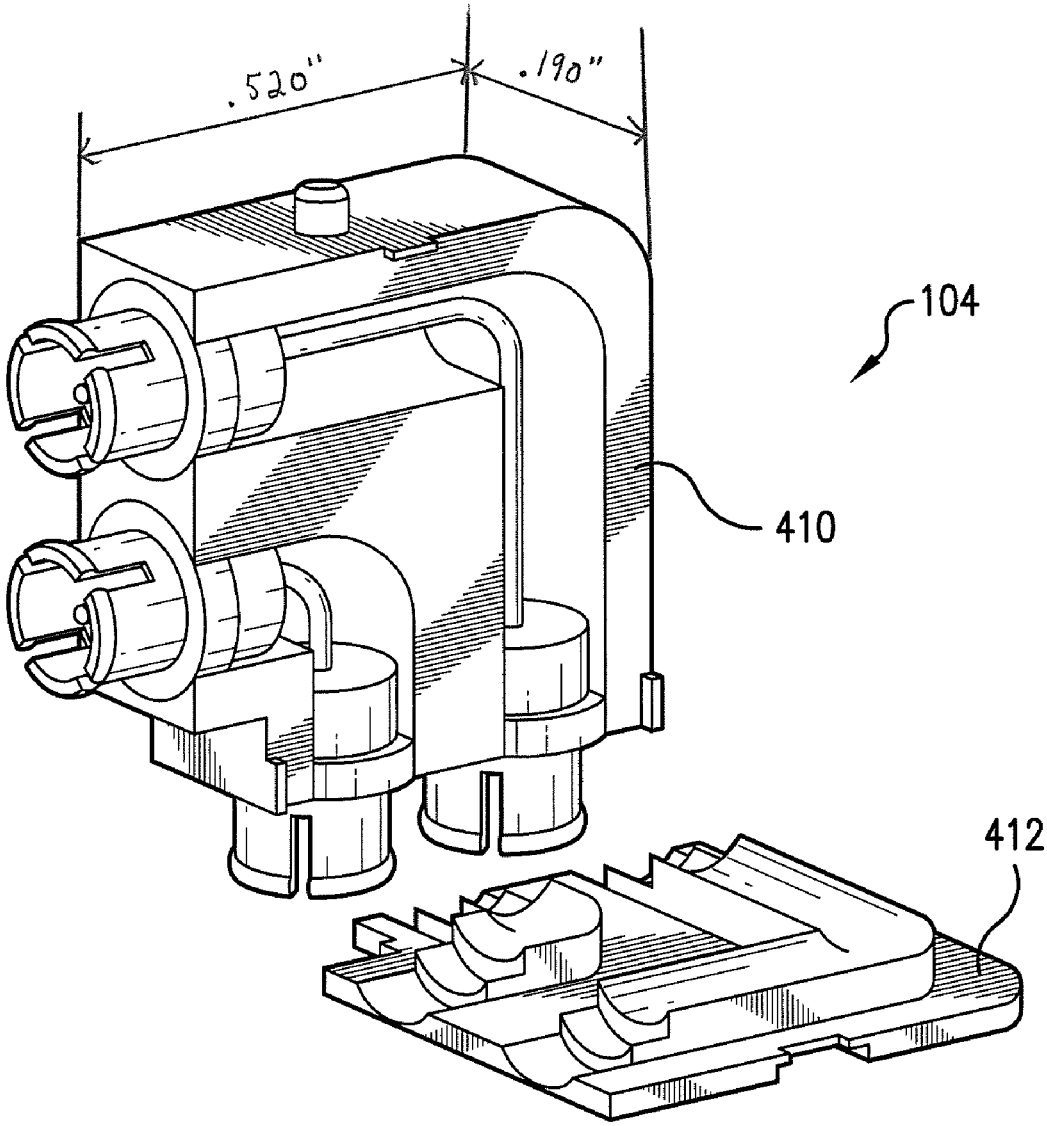

Housing 404 may be a one-piece structure or a multi-piece structure. In the embodiment shown, housing 404 is a two-piece structure. That is, housing 404 includes a main body 410 and a cover 412 that releasably connects to main body 410. Referring now to FIG. 5, FIG. 5 shows cover 412 being disconnected from main body 410. FIG. 5 also shows that main body 410 may have channels 502 and 504 in which the middle portions of signal contacts 406*a* and 406*b* are disposed, respectively. This feature is further shown in FIGS. 6 and 7. FIG. 6 also shows that an end portion of each contact 408 is disposed inside of main body 410 and that two members 402 (e.g., 402*a* and 402*b*) may project from body 410 (e.g., member 402*a* projects from a first side of body 410 and member 402*b* projects from a second side of body 410, which second side may be perpendicular to the first side). FIG. 7 shows module 104 with the contacts 408 removed so that the ends 710*a*, 710*b* of signal contact 406*a* and the ends 712*a*, 712*b* of signal contact 406*b* can be seen. As shown, ends 710*a,b* and 712*a,b* extend beyond the boundary of main body 410. FIG. 7 also shows that a dielectric positioner 702 can be used to position (e.g., center) the signal contacts 406 within the channels in which they reside. Referring to FIG. 8, FIG. 8 illustrates that body 410 may have a length of about one half of an inch and a width of about two tenths of an inch. Given the small size of module 104, interconnect 100 is, in some embodiments, referred to as a micro-interconnect.

Figure 9:
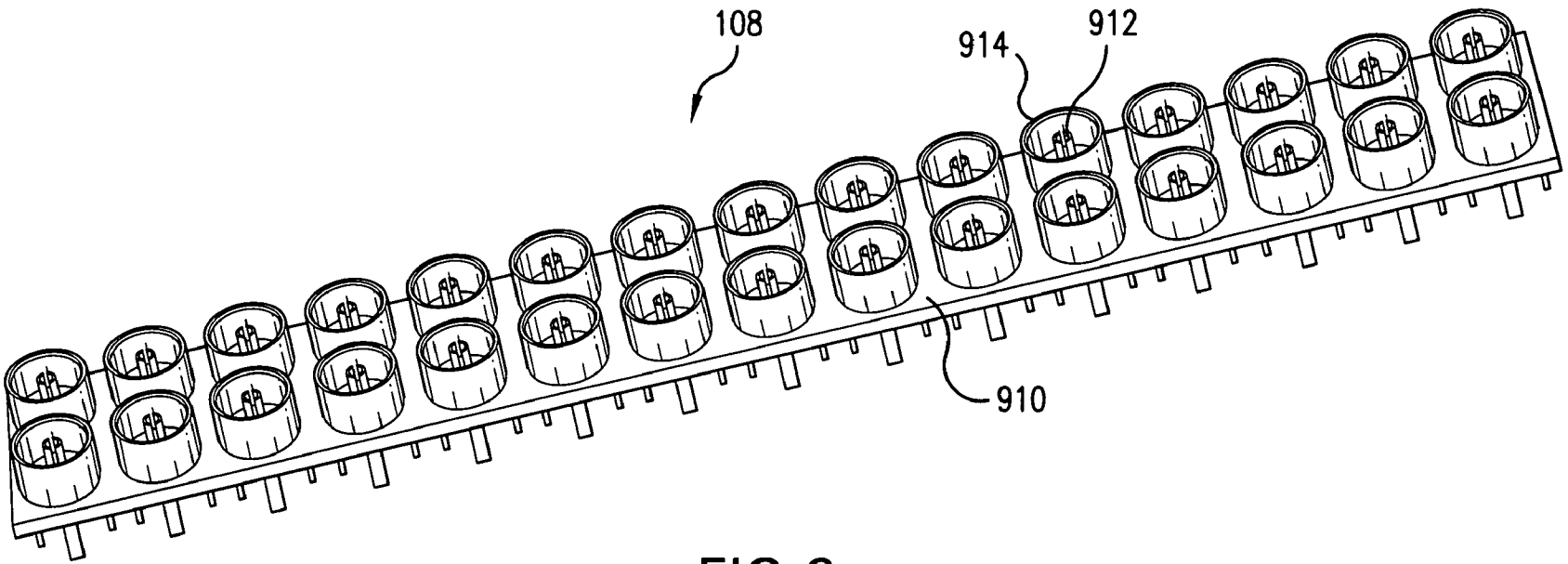
FIGS. 9-10 illustrate a header assembly according to an embodiment of the invention.
Figure 10:
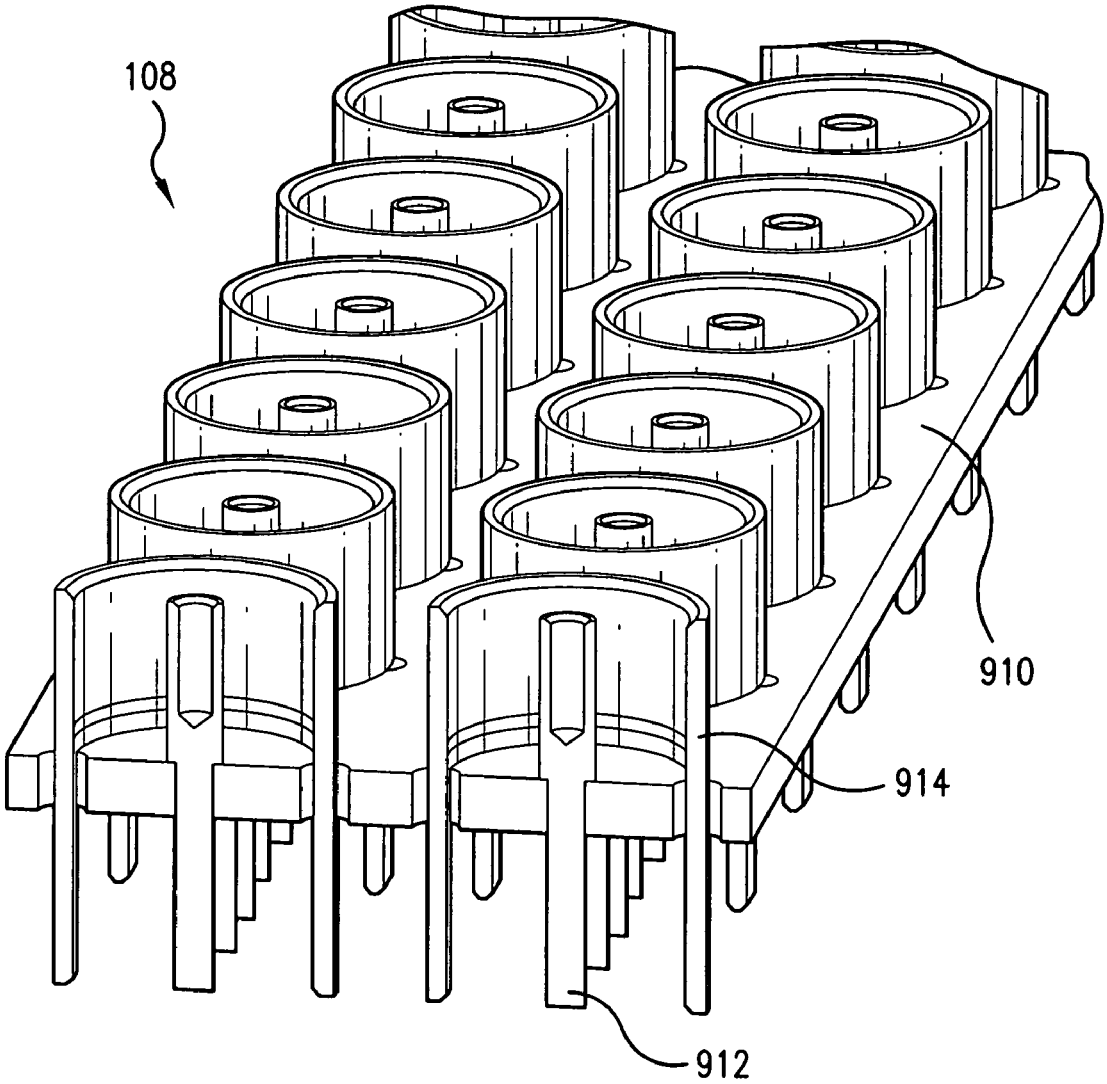
Figure 11:
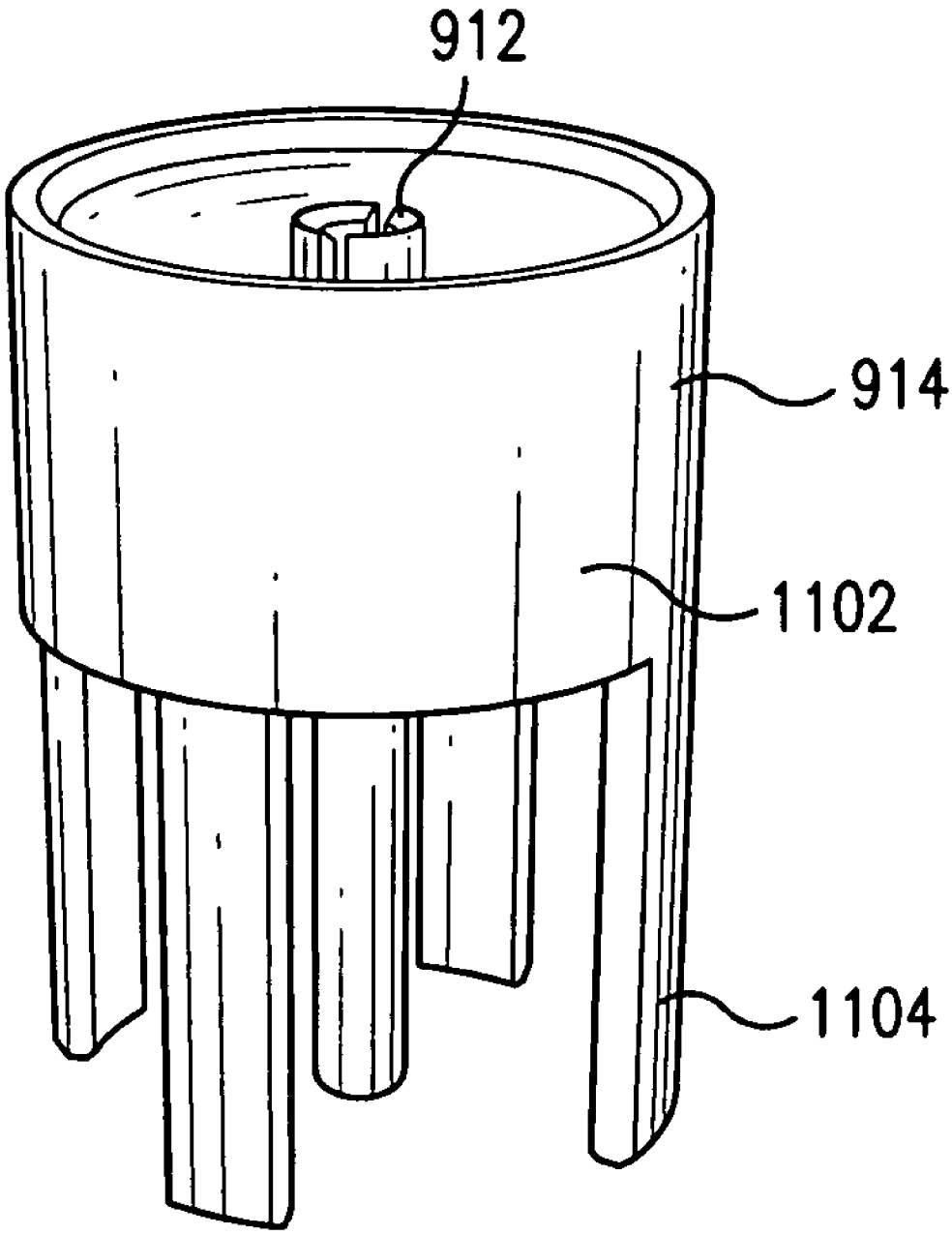
FIG. 11 illustrates a signal contact and a ground contact of the header assembly.

Referring now to FIG. 9, FIG. 9 shows a header assembly 108 according to an embodiment of the invention. Header assembly 108 includes a dielectric substrate 910 that supports a plurality of signal contacts 912 and a plurality of ground contacts 914 in a spatial arrangement. Substrate 910 may contain circuitry and/or conductive plating to enhance signal performance. For example, substrate 910 may include copper plated holes that are arranged to enhance electromagnetic interference (EMI) and isolation of a coaxial transmission line. The signal contacts 912 and ground contacts 914 protrude from both sides of substrate 910, thereby allowing each signal contact 912 to mate with signal contact 406 of a coaxial module 104 and allowing each ground contact 914 to mate with a ground contact 408 of a coaxial module 104. This feature is further illustrated in FIG. 10, which shows a cross-sectional view of assembly 108. As shown in FIG. 10, each signal contact 912 and each ground contact 914 passes through substrate 910. As also shown in FIG. 10, an end portion of each signal contact is surrounded by an end portion of each ground contact and the signal contact 912 is coaxial with the ground contact 914. An embodiment of ground contact 914 is shown in FIG. 11. In the embodiment shown, ground contact 914 includes a ring shaped portion 1102 and four legs 1104 projecting from an end of ring 1102. Legs 1104 are generally aligned parallel with the central axis of ring 1102. Legs 1104 may be integrally connected to ring 1102.

The above described interconnect may be used to enable high-frequency (e.g., 0 to 12 Giga Hertz) electrical signal transmission between two components (e.g., a first component on a first circuit board and a second component on a second circuit board, which may be aligned at a right angle to or parallel with the first circuit board). The interconnect is modular in that it may include an array of modules, which are held in place by frame. The modules may snap into and out of the frame, thereby permitting variability and customization of the quantity of mated lines. Additionally, per the requirements of the application, the array of modules may include modules specifically designed for transmitting low frequency as well as modules specifically designed for transmitting power.

While various embodiments of the present invention have been described above, it should be understood that they have been presented by way of example only, and not limitation. Thus, the breadth and scope of the present invention should not be limited by any of the above-described exemplary embodiments.

What is claimed is:

1. An interconnect, comprising:

a frame; and a plurality of coaxial modules connected to the frame, wherein each of the plurality of coaxial modules comprises:

a signal contact having a middle portion, a first end and a second end;

a first ground contact surrounding the first end of the signal contact, wherein the first end of the signal contact is coaxial with the first ground contact;

a second ground contact surrounding the second end of the signal contact, wherein the second end of the signal contact is coaxial with the second ground contact; and a housing, wherein the middle portion of the signal contact is disposed within the housing, the first end of the signal contact extends beyond the housing, the second end of the signal contact extends beyond the housing, the first ground contact has a first end disposed within the housing and a second end that extends beyond the housing and surrounds the first end of the signal contact, and the second ground contact has a first end disposed within the housing and a second end that extends beyond the housing and surrounds the second end of the signal contact, wherein the frame is an L shaped frame and each said signal contact is also L shaped.

2. The interconnect of claim 1, further comprising:

a first guide module connected to the frame and positioned at a first end of the frame;

a second guide module connected to the frame and positioned at a second end the frame that is opposite the first end;

a first guide pin having a first end and a second end; and a second guide pin having a first end and a second end, wherein the first guide module has a cavity and at least the first end of the first guide pin is located in the cavity, but the second end of the first guide pin is not located in the cavity, and the second guide module has a cavity and at least the first end of the second guide pin is located in the cavity, but the second end of the second guide pin is not located in the cavity.

3. The interconnect of claim 2, wherein the second end of the first guide pin is threaded and the second end of the second guide pin is threaded.

4. The interconnect of claim 2, wherein the first guide module has a member that projects outwardly from a body of the guide module, and the frame includes a hole that receives said member.

5. The interconnect of claim 1, further comprising a header assembly comprising a plurality of ground contacts and a plurality of signal contacts, each of said ground contacts of the header assembly being connected to one of the plurality of first ground contacts and each of said signal contacts of the header assembly being mated with the first end of one of the plurality of signal contacts.

6. The interconnect of claim 5, wherein the header assembly comprises a dielectric substrate having a top side, a bottom side, and a plurality of holes extending from the top side to the bottom side, a portion of each ground contact of the header assembly is located in one of the plurality of holes so that each said ground contact protrudes from both the top side and bottom side of the substrate, and a portion of each signal contact of the header assembly is located in one of the plurality of holes so that each said signal contact protrudes from both the top side and bottom side of the substrate.

7. The interconnect of claim 1, wherein each housing includes a member that projects from a side of the housing, and the frame includes a plurality of holes, wherein each said hole receives one of said members.

8. The interconnect of claim 1, wherein at least one of the coaxial modules comprises a second signal contact having a first end, a second end, and middle portion, the housing of said at least one coaxial module has a first channel and a second channel that are separated from each other by a wall, the middle portion of the first signal contact of said at least one coaxial module is located in the first channel, and the middle portion of the second signal contact of said at least one coaxial module is located in the second channel.

9. The interconnect of claim 8, wherein said at least one of the modules includes a first ring shaped dielectric positioner located in the first channel that positions the first signal contact in the first channel.

10. The interconnect of claim 1, wherein each said housing includes a body, wherein the length of the body is about one half of an inch and the width of the body is about two tenths of an inch.

* * * * *